United States Patent [19]

Hobson

[11] 4,029,229

[45] June 14, 1977

[54] LIFT BLADE APPARATUS

[76] Inventor: Lloyd L. Hobson, 312 N. East St., Elnora, Ind. 47529

[22] Filed: Feb. 23, 1976

[21] Appl. No.: 660,336

[52] U.S. Cl. ..... 214/654; 294/104; 294/110 R

[51] Int. Cl.[2] ..... B66F 9/18

[58] Field of Search ..... 294/104, 110 R; 214/651, 653, 654, 655, 620, 147 G, 147 R, 8.5 C

[56] References Cited

UNITED STATES PATENTS

| | | | |
|---|---|---|---|
| 2,760,663 | 8/1956 | Tatum | 214/654 |
| 2,814,403 | 11/1957 | Ericson | 214/654 |
| 3,200,978 | 8/1965 | Brady et al. | 214/620 X |
| 3,310,336 | 3/1967 | Chenault | 214/653 X |

*Primary Examiner*—Frank E. Werner
*Attorney, Agent, or Firm*—Jenkins, Hanley & Coffey

[57] ABSTRACT

A lift blade assembly for engaging a stack of cartons to be lifted by a lift truck. The lift blade assembly comprises a supporting framework, a transmission mechanism and first and second lift blades. The first lift blade has a front portion and a bottom portion and is fixedly attached to the supporting framework. The second blade has a top portion and a front portion and is pivotally attached to the supporting framework upwardly from the first blade. A pusher bar is disposed above the bottom portion of the first blade for upward and downward reciprocation relative thereto. The transmission mechanism is linked to the pusher bar and second blade for transmitting downward motion of the pusher bar into forward and downward motion of the second blade. A spring is provided for urging the pusher bar upwardly from the bottom of the first blade. The downward motion of the pusher bar as the first blade engages and is urged upwardly against the bottom carton of a stack of cartons to be lifted by the apparatus results in forward and downward motion of the second blade to engage the next carton in the stack above the bottom carton. Both cartons are thereby engaged as the stack is lifted.

10 Claims, 4 Drawing Figures

LIFT BLADE APPARATUS

This invention relates to an improved lift blade apparatus for use with lift trucks, and more specifically to an improved lifting blade assembly capable of engaging vertically adjacent containers in a stack of containers to be lifted.

In various material handling applications, and particularly in situations in which a number of cartons stacked one upon another are to be lifted by a lift truck, it is desirable to have an attachment for the lift truck which will engage not only the bottom carton of the stack, but also the next superadjacent carton.

Accordingly, it is an object of this invention to provide an apparatus for a lift truck comprising a lifting blade, wherein a second blade is disposed upwardly from the lifting blade, sensing means are provided on the lifting blade for sensing the engagement of the lifting blade with the bottom container of a stack of containers, and means are provided for transmitting the engagement of the lifting blade and bottom container to the second blade for causing the second blade to engage the next superadjacent container, thereby securely clamping the two containers together in stacked relationship so that they can be lifted together.

It is a further object of the present invention to provide a lifting blade assembly for a lift truck for engaging and lifting a stack of cartons of the type generally referred to in the material handling industry as "folded-top-and-bottom-cap" cartons. The lifting blade and second blade are adapted to engage the folded top cap of the bottom carton in such a stack and some portion of a carton above the bottom one, respectively. In the disclosed embodiment, the second blade is designed to engage the folded bottom cap of the next super-adjacent carton in the stack.

It is a further object of the present invention to provide such a lifting blade assembly wherein the lifting blade has a front portion and bottom portion. The sensing means is a pusher bar disposed above the bottom portion for upward and downward reciprocation relative thereto. The second blade has a top portion and a front portion forwardly and downwardly therefrom, the second blade being pivotally attached to a support member of the assembly upwardly from the lifting blade. The means for transmitting, the motion of the pusher bar to the second blade comprises a mechanical linkage for transmitting, the downward motion of the pusher bar relative to the bottom of the lifting blade into forward and downward motion of the second blade. Such forward and downward motion causes the second blade to engage the folded bottom cap of the next superadjacent carton in the stack as the bottom carton is engaged and lifted.

While the invention is disclosed in the context of a particular type of carton, i.e., a folded-top-and-bottom-cap carton, it is to be understood that various modifications may be made to the embodiment herein presented to render it useful in handling cartons with folded top caps only, or in handling cartons without folded caps. As used herein, such terms as "folded cap carton", "folded cap container" and the like refer to cartons of the type illustrated in, for example, U.S. Pat. No. 3,200,978, issued Aug. 17, 1965 to J. L. Bradey, et al., and titled "Crate and Carton Handling Attachment for Industrial Trucks", and U.S. Pat. No. 3,266,650, issued Aug. 16, 1966 to F. G. Hauschild, et al., and titled "Container Handler". A lift truck attachment for handling folded cap cartons is disclosed in my U.S. Pat. No. 3,023,919, issued Mar. 6, 1962 and titled "Lift Truck Attachment".

Other objects of the present invention will become obvious to those skilled in the art to which the present invention pertains by referring to the follwing description and accompanying drawings of which:

Figure 1:
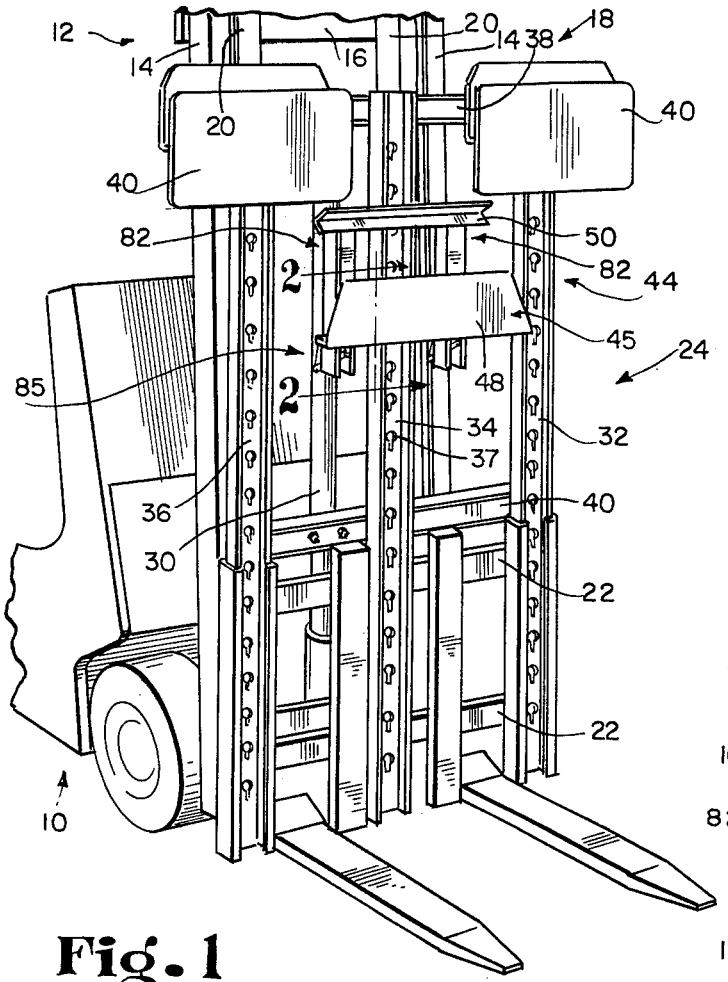
FIG. 1 is a fragmentary perspective view of a lift truck including the apparatus of the present invention.

Referring now to the drawings, a lift truck 10 includes a mast 12 comprising two vertically extending channels 14 joined near their upward ends by a cross member 16. Channels 14 of the mast slidingly receive two vertical members 20 of a conventional frame assembly 18.

Frame assembly 18 also includes a pair of cross members 22 attached to vertical members 20 near their lower ends. Members 22 are proportioned and designed to receive a lift assembly 24.

Frame 18 is movable relative to mast 12 by actuation of a conventional hydraulic piston-and-cylinder arrangement 30. Assembly 24, being connected to frame 18, moves vertically with the frame. Assembly 24 comprises three vertically extending members 32, 34, 36 connected to one another by an upper cross member 35 and a cross member 40. Each of members 32, 34, 36 contains a plurality of vertically spaced-apart keyhole apertures 37 having enlarged upper portions 38 and narrower lower portions 39.

Figure 2:
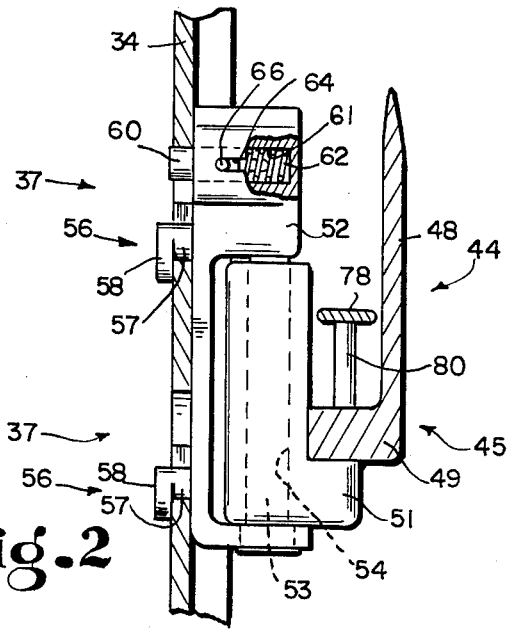
FIG. 2 is a partial fragmentary sectional view taken along section lines 2—2 of FIG. 1.

The center vertical member 34 carries the inventive lifting blade apparatus 44 including a first or lower lifting blade 45 having a vertically extending forward blade portion 48 and a horizontally extending bottom portion 49. Assembly 44 also includes a second or upper blade 50. Assembly 44 is attached to vertical member 34 in a manner best illustrated is FIGS. 2–3.

Bottom portion 49 of the front blade is attached, for example, by welding, to a bracket 51. Bracket 51 is attached to a carrier assembly 52 for limited pivotal movement about a vertical axis with respect thereto by a pin 53 which extends vertically through a bore 54 in bracket 51. The limited pivotal movement of bracket 51 on carrier 52 provides for alignment of a load to be carried by assembly 44 with respect to the lift truck. A pair of vertically spaced apart studs 56 extends rearwardly from carrier 52. Each of studs 56 comprises a narrowed neck portion 57 and an enlarged head portion 58. Head portions 58 slide readily through the enlarged upper ends 38 of apertures 37 in vertical member 34. Assembly 44 is then lowered as stem portions 57 pass into the narrower lower portions 39 of apertures 37, head portions 58 thereby locking assembly 44 upon vertical member 34.

An additional locking button 60 is reciprocable in a rearwardly opening, horizontally extending bore 61 near the upper end of carrier 52. Button 60 is urged rearwardly by a coiled spring 62 disposed in the bore.

Button 60 may be urged forward by manipulating pins 66 in horizontally extending elongated slot 64 to pull button 60 out of the upper extent of one of keyholes 37. The keyhole aperture, stud, and locking button assemblies are all as described in my aforementioned U.S. Pat. No. 3,023,919.

Lifting blade assembly 44 also includes sensing means, desirably a pusher bar 78 disposed upwardly from the lifting blade bottom 49 and reciprocable vertically upon a pair of vertically extending legs 80 which extend through slots 81 in bottom 49.

A pair of vertical support members 82 is attached rewardly of bottom 49. Each of members 82 has a generally C-shaped horizontal cross section (not shown) with a front portion 83 and two side portions 84. Support members 82 carry the upper blade 50 in a manner to be described hereinafter.

A transmission mechanism 85 includes a first linkage arm 88 which is centrally pivoted upon a pin 90 between sides 84 of each of support members 82. A longitudinally extending elongated slot 94 is formed in one end of linkage arm 88. Pins 92 extend through legs 80 and are reciprocable in slots 94 to cause arms 88 to pivot upon pins 90. Pivot pins 96 in the opposite ends of arms 88 pivotally connect arms 88 to two link members 98 which extend upwardly parallel to and between walls 84 of support members 82.

Link members 98 are connected by pivot pins 100 and brackets 102 to blade 50, brackets 102 being attached to the top portion 103 of blade 50 by any suitable method, e.g., by welding. Top portion 103 is also connected to the front 83 of each support members 82 by a hinge 105.

Figure 4:
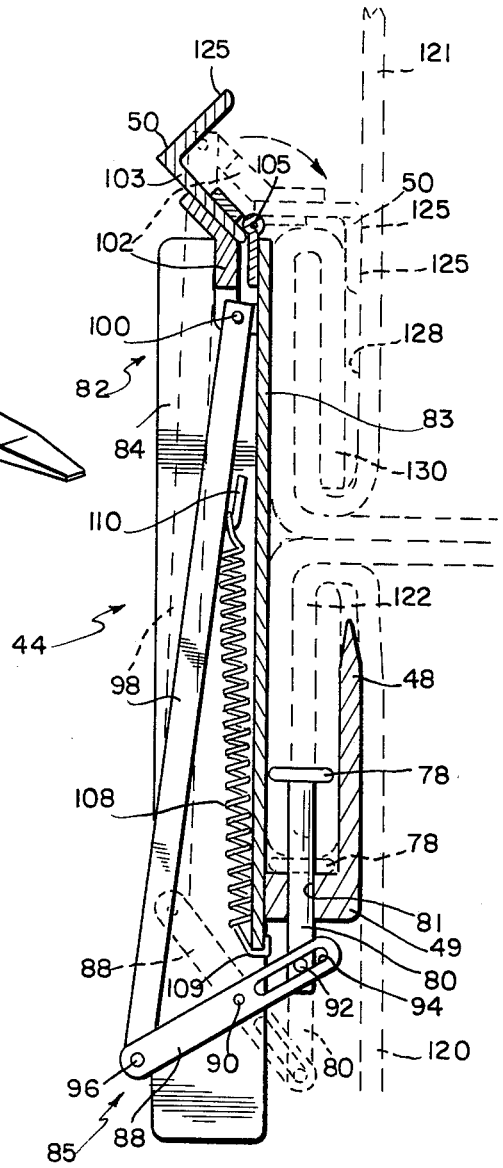
FIG. 4 is a sectional view of the invention taken along section lines 4—4 of FIG. 3, with certain elements thereof, illustrated in both solid and broken lines and fragments of two stacked cartons illustrated in broken lines to show the principles of operation of the inventive apparatus.
Figure 3:
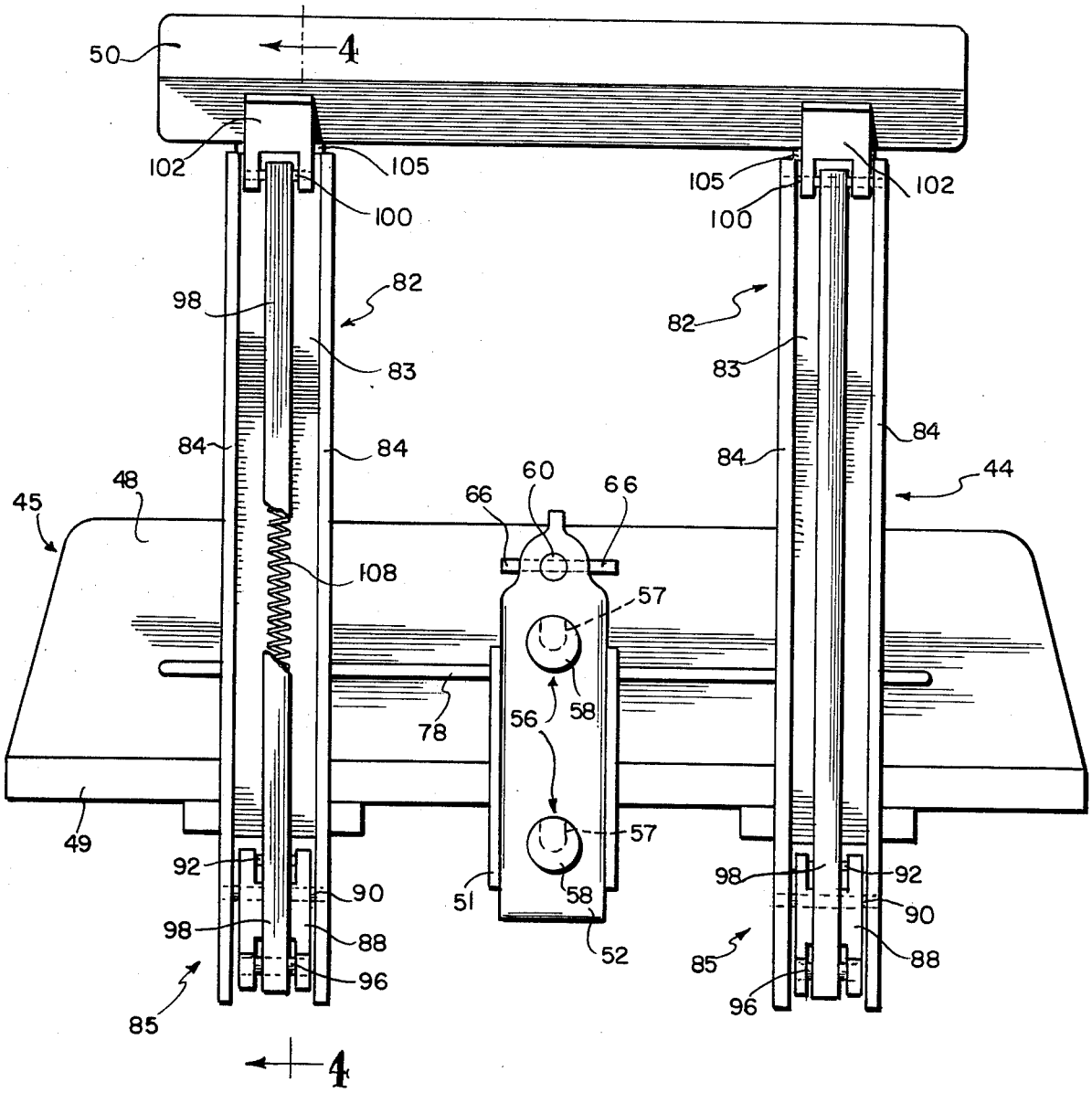
FIG. 3 is a fragmentary elevational view of the apparatus of the present invention.

Blade 50 is urged into its unloaded position, illustrated in solid lines in FIGS. 3–4, by a spring 108 housed within each of support members 82 and extending between a point 109 at the bottom of each of front faces 83 and a point 110 intermediate the ends of each of link members 98.

In operation, as blade 45 is urged into contact with the bottommost folded cap carton 120 (illustrated in broken lines in FIG. 4) of a stack 120, 121 of folded cap cartons, and assembly 44 is raised to urge forward portion 48 of 45 upwardly under the cap 122 of carton 120, pusher bar 78 is urged downwardly into its position illustrated in broken lines in FIG. 4. Linkage arms 88 forced to pivot upon pins 90 forcing link members 98 upwardly and causing blade 50 to pivot upon hinges 105. The front portion 125 of blade 50 is thereby urged forwardly and downwardly into the recess 128 in the folded bottom cap 130 of carton 121, gripping carton 121 securely as carton 120 is engaged. Both cartons can then be lifted.

There is thus disclosed a lift blade apparatus for use with lift truck attachments of the type disclosed in my aforementioned U.S. Pat. No. 3,023,919. This lift blade apparatus provides more secure handling of stacked cartons. It allows the material handler to engage the bottom carton of a stack of cartons to be lifted and, simultaneously, to grip securely a carton stacked above the bottom carton. Of course, the carton to be gripped by second blade 50 need not be the carton directly above the bottom carton in the stack. For example, in a stack of three cartons, it may be desirable to grip securely the bottom carton and the top carton in the stack. The instant invention can, of course, be modified to perform this function, e.g., by increasing the length of support members 82 and link members 98.

Further, the means for transmitting the downward motion of pusher bar 78 into forward and downward motion of blade 50 to engage a carton above the bottom carton in the stack need not be the linkage 80, 88, 98, 102 illustrated. For example, it may be more advantageous in certain situations to provide a hydraulic linkage between pusher bar 78 and blade 50 to transmit motion of the bar to the blade.

Additionally, second blade 50 may be modified, e.g., by hingedly connecting it to a carriage similar to carriage 52, and mounting it separately from blade 45 on vertical member 34. Of course, lift blade assemblies 44 may be mounted upon any of vertical members 32, 34, 36, depending upon the characteristics of the load being handled.

What is claimed is:

1. In a lift truck an apparatus for lifting at least two vertically stacked top and bottom containers, said apparatus comprising a lifting blade for engaging the bottom container, the improvement comprising a second blade disposed upwardly from said lifting blade for engaging said top container, means for sensing the engagement of said lifting blade with the bottom container in said stack in response to vertical movement of the lifting blade relative to said bottom container, and transmitting means for operatively connecting said sensing means to said second blade for causing said second blade to engage said top container for clamping said two containers securely in stacked relationship to lift them together.

2. The improvement of claim 1 and further comprising means for movably supporting said second blade upwardly from said lifting blade and for supporting said sensing means and said transmitting means.

3. The improvement of claim 2 wherein said second blade is hingedly connected to said movable support means for movement forwardly and downwardly to engage said second container.

4. The improvement of claim 2 wherein said support means comprises at least one vertically extending support member having an upper end and a lower end, and said transmitting means comprises an arm member having two ends and pivotally mounted intermediate said ends near the lower end of each said support member, a link member pivotally attached to one end of each said arm member, each link member having upper and lower ends and extending upwardly from said one of said arm member ends, and bracket means movably attached to each said support member, said bracket means further being pivotally attached to said link member and attached to said second blade.

5. The improvement of claim 4 wherein said sensing means comprises a pusher bar pivotally and slidingly attached to the remaining end of each said arm member and having an unloaded position in which it attains its maximum upward displacement with respect to said lifting blade.

6. The improvement of claim 5 wherein said pusher bar is biased to said unloaded position by a spring extending from near the lower end of each said support member to a point intermediate said upper and lower ends of said link member.

7. In combination with a lift truck and a vertical stack of at least two bottom and top containers, a lifting blade apparatus comprising support means, a lifting blade for engaging the bottom container, said lifting blade having a front portion and a bottom portion attached to said support means, an upper engaging blade movably attached to said support means upwardly from said lifting blade, a pusher bar movably attached to said support means above said bottom of said lifting blade for movement with respect to said lifting blade bottom as said lifting blade first moves vertically relative to said bottom container and then engages said bottom container, means for transmitting said movement of said bar to said upper engaging blade for causing said engaging blade to move to engage said top container.

8. The combination according to claim 7 wherein said upper engaging blade is pivotally attached to said support means for forward and downward engaging movement with respect to said support means in response to downward motion of said pusher bar, and for upward and rearward disengaging movement with respect to said support means in response to upward motion of said pusher bar.

9. The combination according to claim 8 wherein said support means comprises a plurality of vertically extending members, each having an upper and a lower end, and said transmitting means comprises an arm member having first and second ends and an intermediate portion, said intermediate portion being pivotally attached to said support member lower end, said first end of said arm member being attached to said pusher bar for movement therewith, a link member pivotally attached to said second end of said arm member, and a bracket pivotally attached to said link member, said bracket being attached to said upper engaging blade for causing said movement thereof.

10. The combination of claim 9 wherein said containers are folded-top-and-bottom-cap containers and said lifting blade is proportioned and designed to engage the folded top cap of the bottom container in said stack and said upper engaging blade is proportioned and designed to engage the folded bottom cap of the next superadjacent container in said stack.

* * * * *